United States Patent [19]

Sassak

[11] Patent Number: 4,487,410

[45] Date of Patent: Dec. 11, 1984

[54] FLUID SUSPENDED PASSENGER CARRYING SPHERICAL BODY HAVING UNIVERSAL ATTITUDE CONTROL

[76] Inventor: John J. Sassak, 36855 Schoolcraft, Livonia, Mich. 48150

[21] Appl. No.: 431,847

[22] Filed: Sep. 30, 1982

[51] Int. Cl.[3] ..... A63J 5/12; G09B 9/08

[52] U.S. Cl. ..... 272/6; 434/34; 434/55

[58] Field of Search ..... 434/55, 56, 57, 34, 434/258; 272/6, 7, 130, 109, 115, 16, 17, 18, 1 C, 1 R, 2; 73/147, 861.75; 104/23 R, 23 FS, 68, 69, 83, 84, 85, 86, 138 R, 138 G, 139

[56] References Cited

U.S. PATENT DOCUMENTS

| | | | |
|---|---|---|---|
| 817,381 | 4/1906 | Matson | 272/6 |
| 2,229,201 | 1/1941 | Williford et al. | 242/6 |
| 2,304,341 | 12/1942 | Dennis | 272/41 |
| 2,344,454 | 3/1944 | Plotner | 434/55 |
| 2,910,865 | 11/1959 | Opdyke | 73/147 |
| 3,135,057 | 6/1964 | Nelson et al. | 434/34 |
| 3,484,953 | 12/1969 | Norheim, Jr. | 272/2 UX |
| 4,272,093 | 6/1981 | Filice et al. | 104/68 X |

FOREIGN PATENT DOCUMENTS

| | | | |
|---|---|---|---|
| 412391 | 4/1925 | Fed. Rep. of Germany | 272/6 |
| 813722 | 3/1937 | France | 272/6 |
| 2094162 | 9/1982 | United Kingdom | 272/2 |

*Primary Examiner*—Robert A. Hafer
*Assistant Examiner*—Arnold W. Kramer
*Attorney, Agent, or Firm*—Charles W. Chandler

[57] ABSTRACT

An amusement device comprising a spherical body for holding a passenger, a ground supported base having a semi-spherical seat for supporting the body in a lower position, a source of air under pressure connected to the base beneath the body for raising it to predetermined position supported solely by air, and an upright tube mounted on the base for guiding the body as it is being raised above the base. Movable control members mounted externally and internally of the body permit the passenger to revolve the body in any direction.

12 Claims, 12 Drawing Figures

FLUID SUSPENDED PASSENGER CARRYING SPHERICAL BODY HAVING UNIVERSAL ATTITUDE CONTROL

BACKGROUND OF THE INVENTION

This invention is related to an air-operated apparatus for raising or lowering a passenger, and more particularly to a passenger-carrying spherical body seated on a semi-spherical base, and air operated means for elevating the body on a cushion of air from the base up through a tube to a predetermined height above the base.

Motion simulators employed in amusement devices and flight simulators usually comprise a hollow body or frame for receiving a passenger. The body is then moved through a series of motions to simulate flight through the air. Such devices are commonly used for training aircraft personnel. Other devices are used as amusement devices with a video screen that presents images consistent with the simulated flight.

The frame is mounted in a cradle or base and rocked or otherwise horizontally moved, usually without any substantial vertical displacement. One device in which the body is horizontally moved is illustrated in U.S. Pat. No. 2,344,454, issued to Plotner in 1944, and disclosing a spherical shell floating on a body of water with controls for rotating the shell about its center.

SUMMARY OF THE INVENTION

The broad purpose of the present invention is to provide apparatus for elevating a passenger in which the passenger is received into a spherical body and then raised to a predetermined height by pressurized air delivered beneath the body. In the preferred embodiment of the invention, which will be described in greater detail, the body is mounted in a semi-spherical base having an upright, transparent, tubular conduit mounted above the base so that the body is raised to an elevated position in the tube. A movable weight is mounted within the body so that the passenger can revolve the body by displacing the weight from the body's center of gravity.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
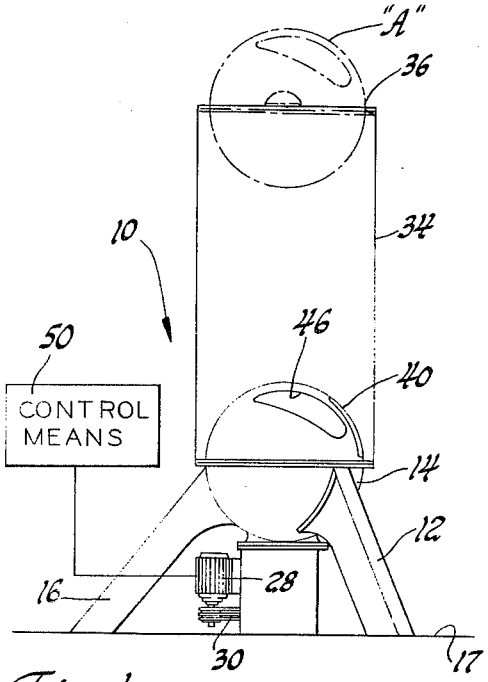
FIG. 1 is a partially schematic view showing an amusement device illustrating the preferred embodiment of the invention.

Referring to the drawings, FIG. 1 illustrates a preferred amusement device 10 comprising base means 12. Base means 12 has a semi-spherical base member 14 supported by legs 16 above ground 17. Base member 14 has a generally spherical seat 18, an upper opening 20 and a lower opening 22. A turbine housing 24 is mounted beneath opening 22

Figure 6:
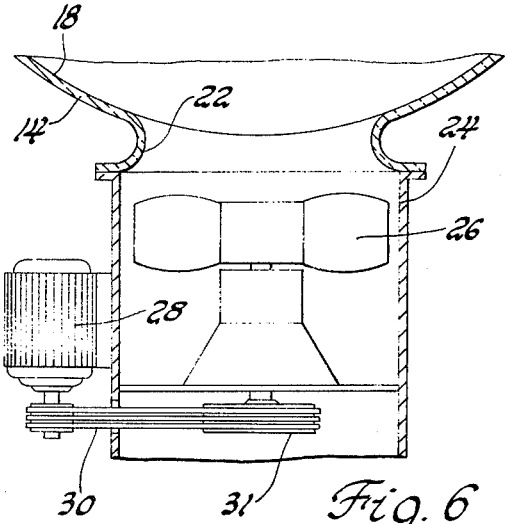
FIG. 6 is sectional view of the turbine housing.

Referring to FIGS. 1 and 6, turbine means 26 is mounted within the housing. A motor 28 is mounted on the housing and connected by belt means 30 for driving the turbine to direct a flow of air trough opening 22 into base member 14.

Belt means 30 includes a sheave 31 weighted so as to form a flywheel in the event power is terminated for some reason to motor 28 so that the turbine continues to rotate for a period of time under the momentum of sheave 31.

Figure 2:
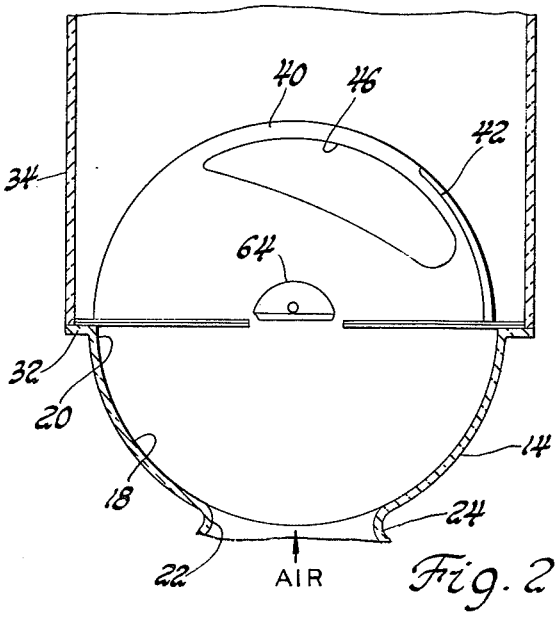
FIG. 2 is a sectional view of the body slightly raised above the base.

Referring to FIGS. 1 and 2, a lip 32 is mounted about the upper edge of opening 20. An upright transparent tube means 34 is mounted on the lip. Tube means 34 has an upper open end 36.

A spheical, passenger holding body 40 is illustrated in FIG. 2, mounted on seat 18. Body 40 has a slidable closure 42 which may be opened to permit a passenger 44 to step into the body. The body also has transparent window means 46 for the passenger to view objects outside of the body. In addition closure 42 is preferrably transparent so that the viewer can view external objects such as a video screen, not shown, which may be operated as the passenger is being elevated.

Body 40 has an external diameter such that it can be disposed on seat 18 of the base, and which is slightly less than that of tube means 34 so that air delivered from the turbine will urge the body upwardly to an elevated position in which it is suspended by the air. The body can be raised several feet to an upward position adjacent the top opening of the tube at "A " illustrated in FIG. 1. The body is raised and lowered by external controls 50 for controlling the operation of the turbine.

Figure 3:
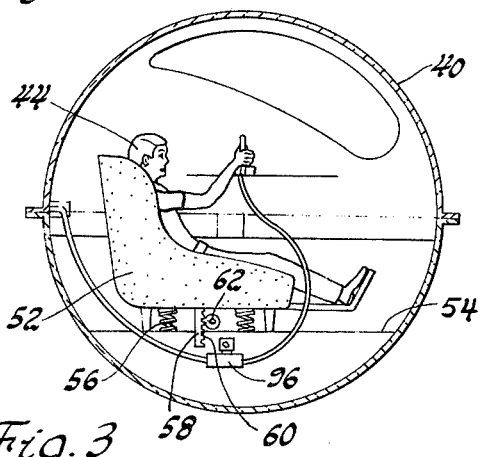
FIG. 3 is an fragmentary view illustrating the internal arrangement of the body.
Figure 4:
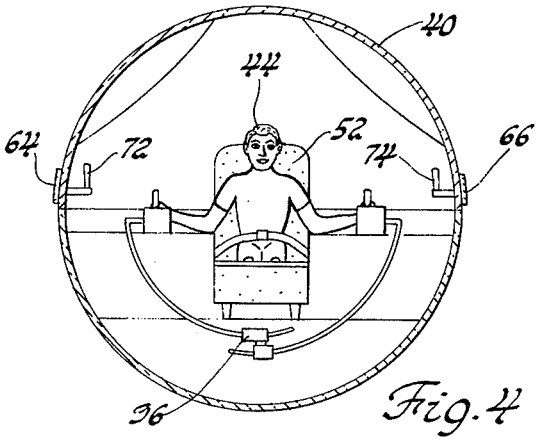
FIG. 4 is another internal view of the body illustrating the weight operated controls.
Figure 5:
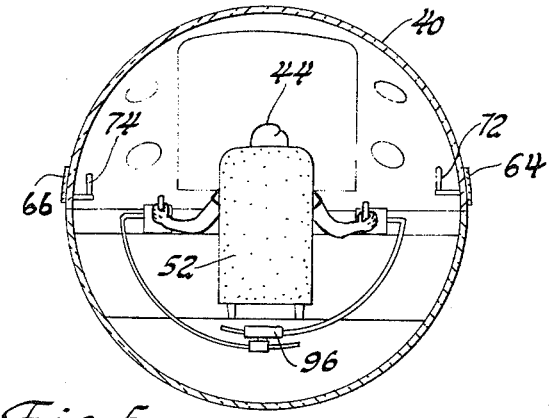
FIG. 5 is still another internal view of the body showing the control arrangement and the simulated controls.

Referring to FIGS. 3, 4 and 5, a 6-way chair 52 is mounted on floor 54 in body 40 for receiving passenger 44. Spring means 56 are mounted between the bottom of the chair and the floor. A rack 58 is carried by the chair and has a series of teeth 60 engageable with a dog 62 in such a manner that when the passenger sits in the chair, the chair is lowered under the passenger's weight and then locked in its lowered position by the dog engaging the rack teeth. Thus the position of the chair and the passenger accommodates the passenger's weight.

In order to change to position of the body in its suspended position, two sets of controls are provided. Referring to FIGS. 2, 4, 7, and 8, a pair of louver means 64 and 66 are mounted on opposite sides of the body closely adjacent its surface. The two louvers are identical except for their positions and each includes a bottom linear surface 70 which has a thickness sufficient to provide a barrier to air being delivered from beneath the body. An internally mounted handle 72 is connected to louver 64, and a second handle 74 is connected to louver 66.

Figure 7:
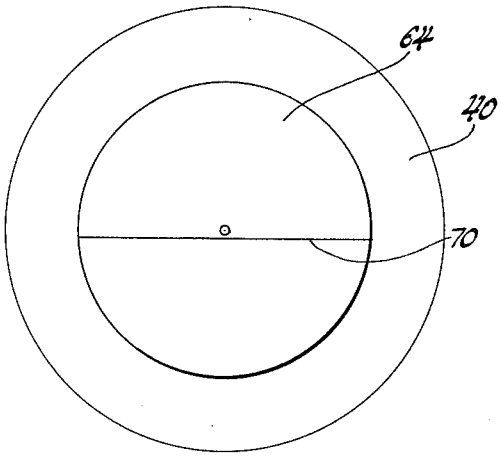
FIG. 7 is a view of the louver used for revolving the body about the tube's axis.
Figure 8:
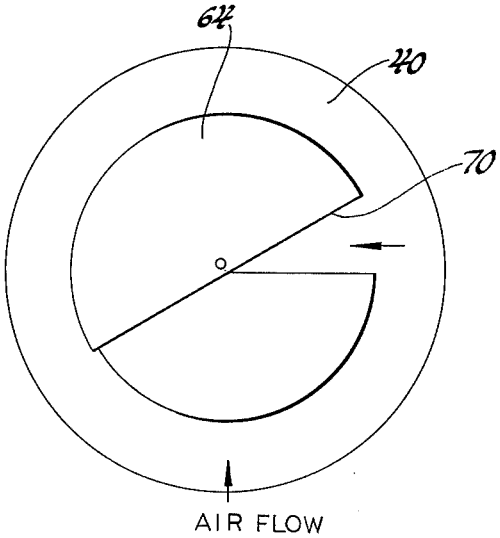
FIG. 8 is a view of the louver in another position.
Figure 9:
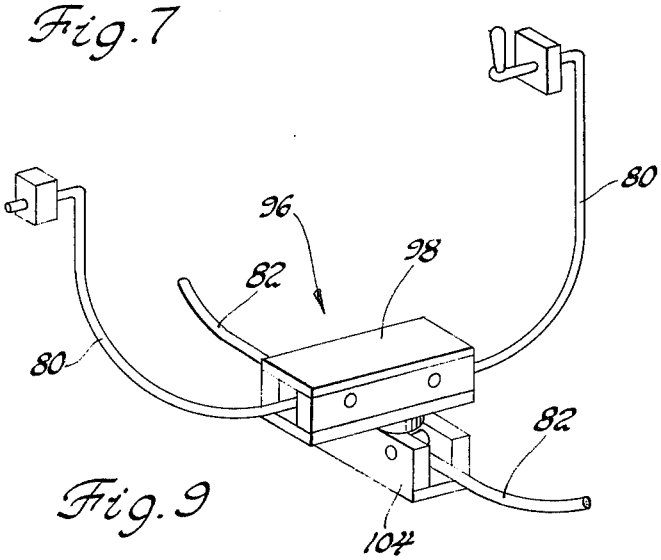
FIG. 9 is a view of the system for controlling the position of the weight.
Figure 11:
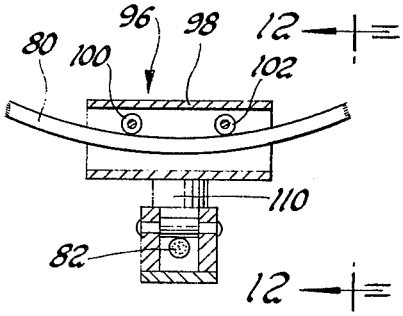
FIG. 11 is a fragmentary view showing the manner in which the weight is connected to the guide rods.

Referring to FIGS. 7 and 8, each louver can be disposed in a generally horizontal position illustrated in FIG. 7 in which the louver is in an essentially neutral position. By slightly tilting the louver to a position illustrated in FIG. 8, the air being delivered from beneath the body and closely adjacent the surface biases the body in the direction in which it has been tilted. By reversing the tilt of the louver, the bias of the air can be directed in the opposite direction. The net result is that the body can be revolved about its vertical axis by tilting the louvers in either one direction or in the opposite direction.

The second system of weight controls is illustrated in FIGS. 3–5 and 9–12. This means comprises a pair of "U" shaped rods 80 and 82. Bearing means 84 supports one end of rod 80 and a bearing 86 supports its opposite end. The two bearings are on opposite sides of chair 52. A handle 88 provides means for the user to pivot the rod about the two bearings.

Similarly, a bearing 90 supports one end of rod 82 and a second bearing means 92 supports the opposite end of rod 82. A handle 94 is connected to the end of rod 82 so the user can pivot it about its bearing. The two rods are mounted so that they are closely adjacent one another. Weight means 96, illustrated in FIGS. 11 and 12, connect the two rods together at their closest point. The weight means include a hollow weight member 98 housing a pair of rollers 100 and 102 so that weight member 98 can be readily moved along rod 80. A second weight member 104, having a predetermined weight, carries a pair of rollers 106 and 108 which ride on rod 82 so that the housing 104 will readily move along rod 82. The weight members 98 and 104 are connected by swivel means 110 which permit the weights to rotate with respect to one another.

Figure 10:
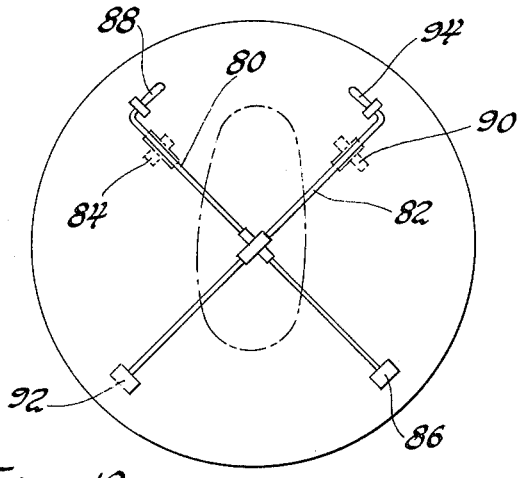
FIG. 10 is a plan schematic view of the weight control system.
Figure 12:
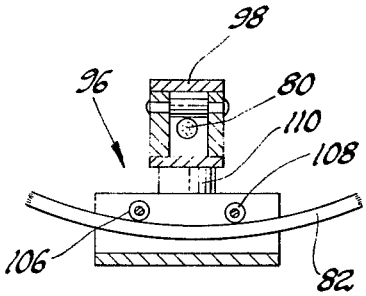
FIG. 12 is a view as seen along lines 12—12 of FIG. 11.

Referring to FIG. 10, the two "U" shaped rods are illustrated with the weight means 96 mounted beneath chair 52 in a neutral position beneath the center of gravity of the body and the passenger. The passenger can move handle 94 to raise rod 82 toward his left thereby moving both weight means 96 along rod 80 toward his left. The displacement of this amount of weight will cause the top of the ball to revolve downwardly and toward his left front. Similarly, by moving weight means 96 along rod 80 toward the passenger's right, he can cause the top of the ball to revolve downwardly toward the right rear.

By moving both of the rods the weight means can be moved in any horizontal direction so that the direction of imbalance caused by moving the weight can be precisely controlled by the user thereby precisely controlling the direction that the body is revolved. The arrangement is such that he can completely and easily move the ball to turn to an upside down inverted position as he is being raised on a cushion of air.

Referring to FIG. 1, the user can control the relative position of the body within the tube 34 as the body is raised to the top of the tube. The height of the body is controlled by control means 50. Should power be suddenly terminated to motor 28, the body will slowly lower on the cushion of air disposed between it and seat 18. The turbine will continue to rotate because of the inertia of sheave 31 thereby providing a controlled drop of the ball so that the user can safely return to seat 18.

Referring to FIG. 5, a series of simulated gauges and controls are disposed within the body. The user can operate a video game in combination with the body motion to simulate space travel and the like. As an alternative he can view an externally mounted screen (not shown) through transparent closure 42 to experience simulated space travel.

Having described my invention, I claim:

1. Apparatus comprising:

a base having a seat with an upper opening and a lower opening;

a spherical passenger-holding body having closure means for receiving a passenger therein, the body being receivable through the upper opening in the base to a lower position in the seat adjacent said lower opening;

means for delivering a fluid through the lower opening in the base beneath the body to raise it above said lower position such that the body is supported solely by the fluid being received through the lower opening in the base and passing out the upper opening; and external control means and internal control means each having means adapted to be operated by the passenger to jointly control the universal attitude of the body when suspended in and by the fluid, the external control means biasing the body by reaction to the fluid and the internal control means biasing the body by imbalance.

2. Apparatus as defined in claim 1 including a vertical tube having a lower opening mounted on the base for receiving the body and guiding it along a predetermined path of motion; and means for delivering the fluid through the lower opening in the base beneath the body to raise it into the tube to a predetermined height above the seat.

3. Apparatus as defined in claim 2, in which the base comprises a semi-spherical member having an upper open end for receiving the body to a position in which it is disposed in the base, lip means connected about the edge of the upper opening, and the lower end of the tube being mounted on said lip means.

4. Apparatus as defined in claim 1 in which the external control means comprises at least one louver member mounted adjacent the exterior surface of the body so as to be movable in a plane parallel to the exterior surface of the body; and the means adapted for manipulation by the passenger being mounted in the body for moving any louver member to adjust the position of the body with respect to the seat.

5. Apparatus as defined in claim 4, in which each louver member is a planar member supported substantially parallel to the exterior surface of the body, and including means for moving the louver member along a path of motion parallel to the surface of the body so as to be disposed in the path of motion of fluid passing closely adjacent the exterior surface of the body.

6. Apparatus as defined in claim 4, including means supporting any louver member for motion between a first position and a second position, such that the air being delivered from beneath the body along the surface thereof biases the body toward motion in a first direction when the louver is in said first position and in the opposite direction when the louver is in its second position.

7. Apparatus as defined in claim 4, wherein the means for manipulation by the passenger includes handle means mounted in the body for the passenger to move any louver to a selected position.

8. Apparatus as defined in claim 1, in which the internal control means includes a first elongated member mounted in the body, said first elongated member having a mid-section supported by a pair of ends;

means mounting the ends of the first elongated member such that the mid-section thereof is swingable about said ends;

a second elongated member mounted in the body, the second elongated member having a mid-section supported by a pair of ends;

means mounting the ends of the second elongated member in the body such that the mid-section is swingable about the ends thereof in a motion independent of the motion of the first elongated member;

a controlled member supported on both of said elongated members so as to be movable along both of said elongated members to a position in the body depending upon the position of the first elongated member with respect to the second elongated member whereby the body can be revolved by moving the controlled member to a position in which it is horizontally spaced from the center of gravity of the body and the passenger.

9. An apparatus as defined in claim 8 in which each of said elongated members has a "U" shaped mid-section.

10. An apparatus as defined in claim 1, said body having a transparent window so that the passenger can view objects outside of the body.

11. Apparatus as defined in claim 1, in which the fluid comprises air.

12. Apparatus comprising:

a base having a hemispherical seat, an upper opening above the seat, and a lower opening;

a spherical passenger-holding body having closure means for receiving a passenger therein, the body being receivable through said upper opening to a lower position in the seat;

means for delivering air through the opening in the base beneath the body to raise it and the passenger above said lower position toward said upper opening such that the body is supported solely by air passing from the lower opening toward said upper opening;

an upright tube mounted on the base to receive the body as it is being raised from said lower position and to guide the body along a predetermined upward path of motion defined by the tube;

at least one louver member mounted adjacent the exterior surface of the body so as to be disposed between the body and the tube wall in the path of air moving adjacent the surface of the body to bias it toward rotation in said tube;

control means mounted in the body for permitting the passenger to move any louver member to adjust the rotation of of the body;

a controlled member mounted in the body for adjusting the center of gravity of the body and passenger whereby the body revolves in the tube from a first position toward a second position while supported in said raised position;

whereby the passenger is able to control any louver member and the controlled member from a position within the body so as to revolve the body to any attitude while supported in the tube in said raised position.

* * * * *